US006571863B1

(12) United States Patent
Liu

(10) Patent No.: US 6,571,863 B1
(45) Date of Patent: Jun. 3, 2003

(54) TURBULENCE INDUCING HEAT PIPE FOR IMPROVED HEAT TRANSFER RATES

(75) Inventor: Chen-Hua Liu, Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 10/064,879

(22) Filed: Aug. 27, 2002

(51) Int. Cl.[7] ..... F28D 15/00

(52) U.S. Cl. ..... 165/104.21; 165/104.22; 165/104.26; 165/104.33; 361/700; 174/15.2

(58) Field of Search ..... 165/104.19, 104.21, 165/104.22, 104.26; 361/699, 700; 174/15.2

(56) References Cited

U.S. PATENT DOCUMENTS

| | | | | | |
|---|---|---|---|---|---|
| 3,603,382 | A | * | 9/1971 | Paine | 165/104.26 |
| 3,967,591 | A | * | 7/1976 | Iida | 165/104.26 |
| 2002/0139517 | A1 | * | 10/2002 | Choi et al. | 165/104.26 |

FOREIGN PATENT DOCUMENTS

| | | | | | |
|---|---|---|---|---|---|
| JP | 60-011092 | A | * | 1/1985 | 165/104.26 |
| JP | 60-103296 | A | * | 6/1985 | 165/104.26 |

* cited by examiner

*Primary Examiner*—Henry Bennett
*Assistant Examiner*—Terrell McKinnon
(74) *Attorney, Agent, or Firm*—Winston Hsu

(57) ABSTRACT

A heat pipe for transferring heat from a heat source to a heat dissipater. The heat pipe includes a tube encasing a low viscosity working fluid and at least one radially segmented disk to restrict the flow of the working fluid to a single direction around the interior of closed loop of the tube. The tube additionally has a first surface adapted to contact at least a portion of a heat source, and a second surface adapted to contact at least a portion of a heat dissipater. The heat source vaporizes the working fluid, pressure forcing the fluid to circulate throughout the enclosed loop of the tube, the vapor being cooled and re-condensed while near the heat dissipater. Each radially segmented disk includes a plurality of segments designed to introduce turbulence into the fluid flow to increase heat transfer rates.

20 Claims, 8 Drawing Sheets

TURBULENCE INDUCING HEAT PIPE FOR IMPROVED HEAT TRANSFER RATES

BACKGROUND OF INVENTION

1. Field of the Invention

The present invention relates to a heat pipe for transferring heat from a heat source to a heat dissipater. More specifically, a looped heat pipe for transferring heat by regulating the direction of fluid flow and introducing turbulence into the fluid flow to increase heat transfer rates from the heat source to the heat pipe and from the heat pipe to the heat dissipater is disclosed.

2. Description of the Prior Art

The dissipation of heat generated by modern electronic components has become a major concern for designers of many modern devices. Approaches to the problem vary from passive heat sinks to external liquid refrigeration systems. One common solution to the problem is to transfer heat away from the heat source, via a heat pipe or other device of similar functionality, to a location where it can be dissipated more readily.

FIG. 1 illustrates the concept of a simple prior art heat pipe comprising a hollow tube. Enclosed in the upright tube is a working fluid, often a freon derivative. Here the term "upright" means a combination of a vertical disposition and having the heat source at or near the bottom of the tube and the cooling region at or near the top of the tube. When heat is applied to a heat absorbing region of the heat pipe, the working fluid absorbs the heat through vaporization and expands toward the heat dissipating region where the working fluid releases the latent heat through condensation, and due to gravity, falls back to the heat absorption region completing the cycle.

FIG. 2 demonstrates a slightly more complicated version of a prior art heat pipe. The heat pipe shown in FIG. 2 is oriented in less than an upright position so that gravity no longer exerts a great enough force on the re-condensed working fluid to adequately return it to the heat absorption region for recycling. In this case, some kind of wick-like structure 25 lines the walls of the tube, drawing the re-condensed working fluid back to the heating region via capillary action.

There additionally are looped variations of the basic types of heat pipes as shown in FIG. 3. A conventional looped heat pipe 32 also comprises a working fluid, a heat absorbing region 35, a heat dissipating region 34, an expansion pipe 37, and a return pipe 39. As before, heat is absorbed in the heat absorbing region by the working fluid through vaporization. The vaporized working fluid flows up through the expansion pipe 37 into the heat dissipating region 34 where the working fluid condenses, releasing latent heat due to cooler temperatures present in the heat dissipating region 34. The return pipe 39 conventionally comprises a wick-like structure to return the condensed working fluid from the heat dissipating region 34 to the heat absorbing region 35 through capillary action. The main purpose of providing a separate expansion pipe 37 and return pipe 39 is to reduce the inhibiting forces acting between the vaporized working fluid and the returning condensed working fluid trying to flow in two opposite directions in the same pipe.

Although a closed loop, the capillary action caused by the wicks in the return pipe 39 is still necessary to cause the various working fluid states to circulate properly. Additionally, wicks have the disadvantage of usually requiring a wire mesh to support them and perhaps more critically, have limitations as to length in their ability to furnish adequate capillary action for the proper functionality of the heat pipe 32.

Wick-less looped heat pipes are disclosed in U.S. Pat. No. 2,518,621, U.S. Pat. No. 3,929,305, and U.S. Pat. No. 4,921,041. Of particular interest is U.S. Pat. No. 4,921,041 where the wick-like structures have effectively been replaced by a plurality of check valves, each check valve restricting working fluid flow to a single direction resulting in proper circulation. The check valves propel and amplify expansion forces generated during working fluid vaporization to force circulation in the direction controlled by the check valves.

However, any fluid flowing within the confines of a pipe conforms to a series of well establish physical laws. Please refer to FIG. 4 showing a portion of a pipe 50 filled with a fluid flowing through the pipe from left to right. As fluids flow, they exhibit viscous tendencies, that is, the fluid molecules tend to stick to any nearby solid surface as well as to other fluid molecules nearby. As a result, not all of the fluid within the pipe flows at the same rate but conceptually form telescoping tubes of fluid with the cross-sectional center moving faster than the cross-sectional edges. In FIG. 4, the arrows 52–58 represent possible relative velocities of the laminar flowing fluid at differing locations within the pipe. This uniform laminar flow reduces the heat transferring ability of the fluid because the cooler portions of the fluid, those near the wall such as 52, do not readily mix with the warmest portions of the flow, 58 in the center. The fluid near arrow 58 is never in contact with the cooling wall of the pipe 50 and any heat dissipation from the fluid designated by the arrow 58 must migrate across the arrows 56, 54, and 52 before being released from the system. Additionally, the difference in temperatures between adjacent arrows is smaller than the difference between 52 and the cooling wall of the pipe 50 further inhibiting the transfer of heat.

While the "041" patent successfully eliminates wick-like structures from heat pipe construction, it fails to address one of the most critical functions of a heat pipe, that of transferring the latent heat out of the vaporized working fluid as efficiently as possible while in the heat dissipating region. Conventional check valves permit the fluid in the center of the pipe to flow more easily than the fluid near the circumference of the heat pipe, further inhibiting the transfer of heat as described in the previous paragraph.

It is obvious that the more efficiently the heat is removed from the vaporized working fluid, the more efficient the heat pipe becomes. What is needed is a heat pipe design which not only eliminates the length limitations imposed by wick-like structures, but a heat pipe design that transfers the latent heat out of the vaporized working fluid more effectively, therefore dissipating heat more effectively and resulting in a more efficient heat pipe.

SUMMARY OF INVENTION

It is therefore a primary objective of the claimed invention to improve heat transfer rates in a wick-less heat pipe by improving fluid flow. Another objective of the claimed invention is to provide a heat pipe with an increased ability to operate properly in unconventional orientations relative to a heat source.

Briefly summarized, the claimed invention includes a tube of suitable length to form a sealed, closed loop. The tube additionally has a first surface adapted to contact at least a portion of a heat source to function as a heat absorbing region and a second surface adapted to contact at least a portion of a heat dissipater to function as a heat dissipating region. The tube encases a low viscosity working fluid for transferring heat from the heat absorbing region to the heat dissipating region. At least one radially segmented disk is in the tube to act as a one-way flow regulator to restrict the flow of the working fluid around the interior of closed loop of the tube to a single direction from an upstream side of the radially segmented disk to a downstream side of the radially segmented disk.

The radially segmented disk has an outer edge of each segment hinged to a thin-walled, pipe shaped spacing ring. The hinges allow the segments to pivot from a closed orientation to an open orientation or from the open orientation to the closed orientation. The closed orientation forms a substantially planar, fluid blocking structure for preventing a flow of the working fluid toward the upstream direction through the radially segmented disk. The open orientation has the segments pivoted in a downstream direction allowing the flow of the working fluid in a downstream direction. When the fluid pressure on the upstream side of the radially segmented disk is greater than the pressure on the downstream side of the radially segmented disk, the segments pivot from the closed orientation to the open orientation. When the fluid pressure on the downstream stream side of the radially segmented disk is greater than the pressure on the upstream side of the radially segmented disk, the segments pivot from the open orientation to the closed orientation. One example of the claimed invention has the segments elastically hinged to the spacing ring for aiding the segments return to a closed orientation when the fluid pressures on the two sides of the radially segmented disk are substantially equal.

The specially designed radially segmented disk controls the circulating direction of the working fluid and amplifies circulation propulsion forces provided by the vaporization of the working fluid near the heat absorbing region and forces provided by the condensation of the working fluid near the heat dissipating region. When the radially segmented disk is not in the closed orientation, edges of the segments create turbulence in the working fluid to increase heat transfer rates to and from the working fluid.

It is an advantage of the claimed invention that the turbulence inducing segments of the radially segmented disk can dissipate the heat more quickly and more efficiently. Additionally the pivoting of the segments from the closed orientation to the open orientation provide propulsion to continue working fluid circulation with an increased ability to operate properly in unconventional orientations relative to a heat source.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 7:
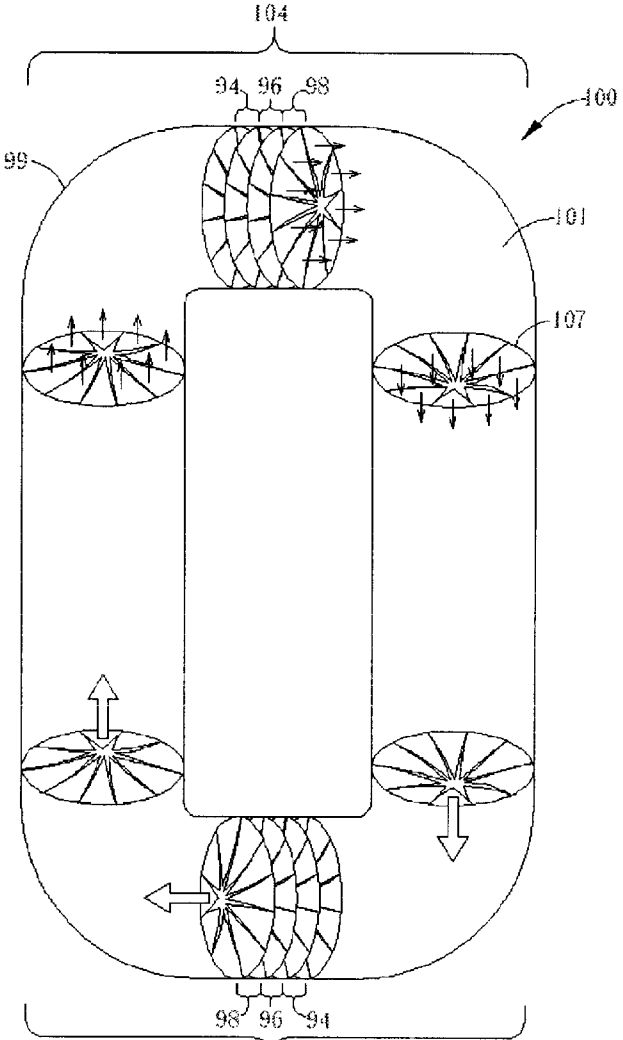
FIG. 7 illustrates one example of the present invention.

Please refer to FIG. 7 illustrating a heat pipe according to the present invention. The heat pipe 100 comprises an elongated hollow tube 99, a substantially incompressible working fluid 101 for transferring heat, and at least one radially segmented disk unit 107 for regulating the direction of flow of the working fluid 101 around the tube 99. There should be enough working fluid 101 in the tube to guarantee presence of at least some of the working fluid 101 in the heat absorbing region 102 when the heat pipe 100 in not being used. This insures vaporization of the working fluid 101 and proper functioning of the heat pipe 100 when heat is applied to the heat absorbing region 102. Additionally, the volume of the working fluid 101 must be less than the interior volume of the tube 99 to allow some expansion of the working fluid due 101 to vaporization. The working fluid should have a high heat capacitance and high heat transfer coefficient such as freon but is not limited to being freon.

The tube 99 is at least long enough to form a closed, seamless loop and is substantially made of copper or aluminum for strength and good heat conducting characteristics. The optimal dimensions of the tube 99 depend on the specific use and orientation. A very narrow tube will increase capillary action but slow the circulation of the working fluid 101. A heat source at the lowest point of the tube 99 and a heat dissipater at the highest point in the tube 99 allows a faster circulation of the working fluid 101 and larger transfer of heat available in a larger diameter tube 99 because gravity complements the pressure driven forces circulating the working fluid 101. The tube 99 comprises at least one heat absorbing region 102 adapted to contact at least a portion of a heat source and at least one heat dissipating region 104 adapted to contact at least a portion of a heat dissipater. Adjacent radially segmented disk units 107 separate the tube 99 into chambers 94, 96, and 98. The working fluid 101 is free to circulate in a clockwise direction but is prevented from moving in a counter-clockwise direction by the flow-regulating radially segmented disk units 107.

Figure 1:
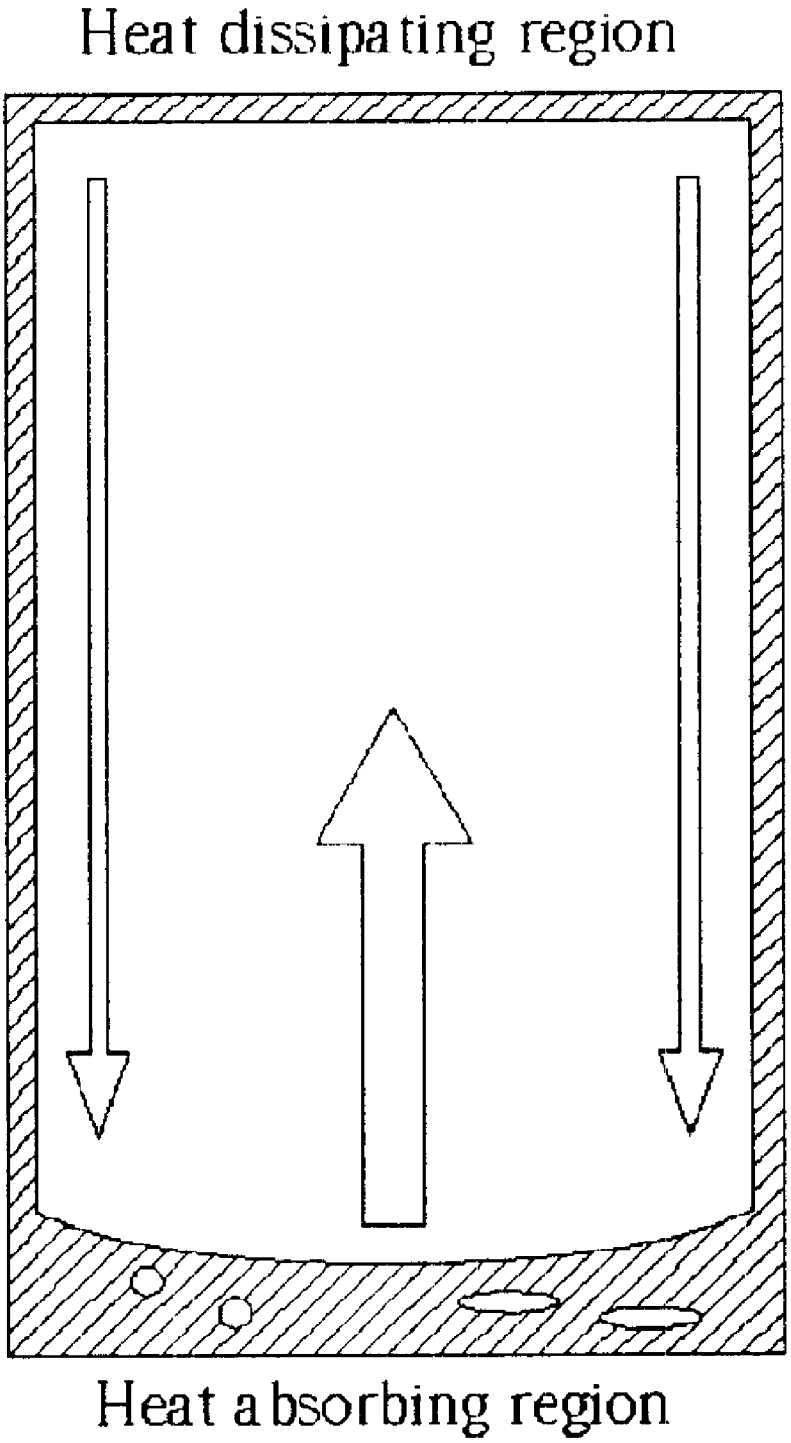
Fig. 1 Prior art
FIG. 1*a* is an illustration of a gravity assisted heat tube according to the prior art.
Figure 2:
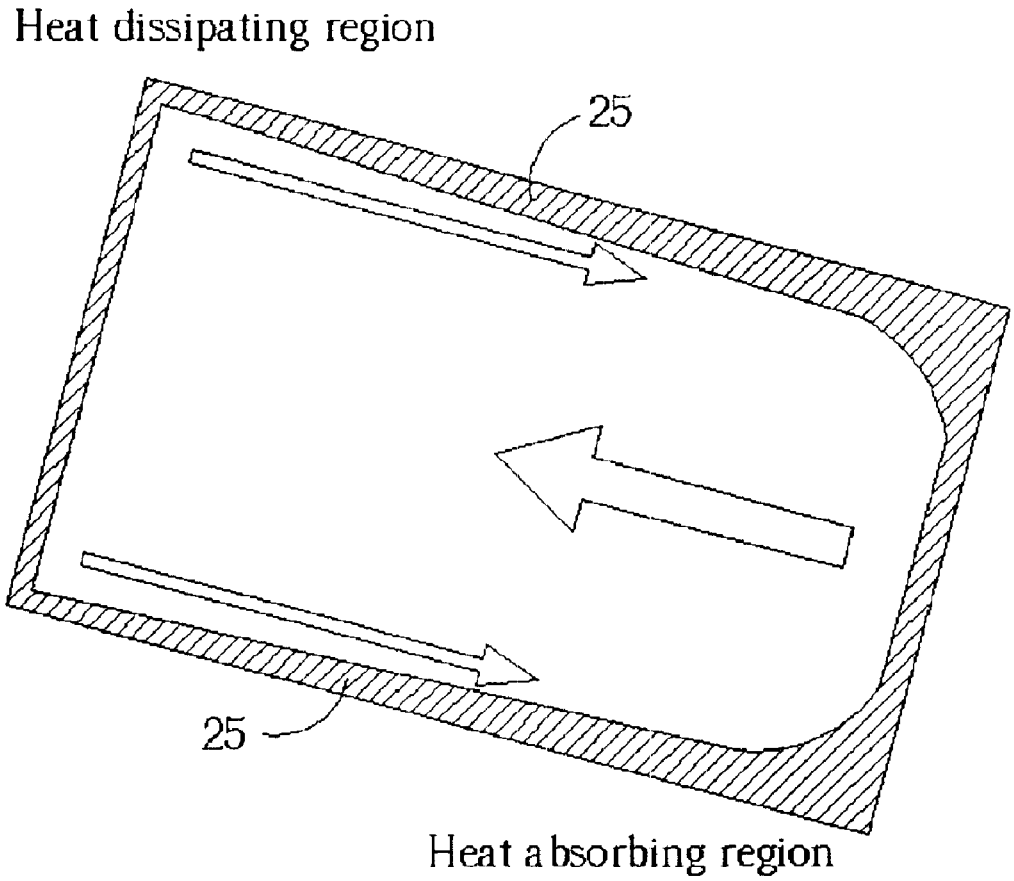
Fig. 2 Prior art
FIG. 2 is an illustration of a capillary assisted heat tube according to the prior art.
Figure 3:
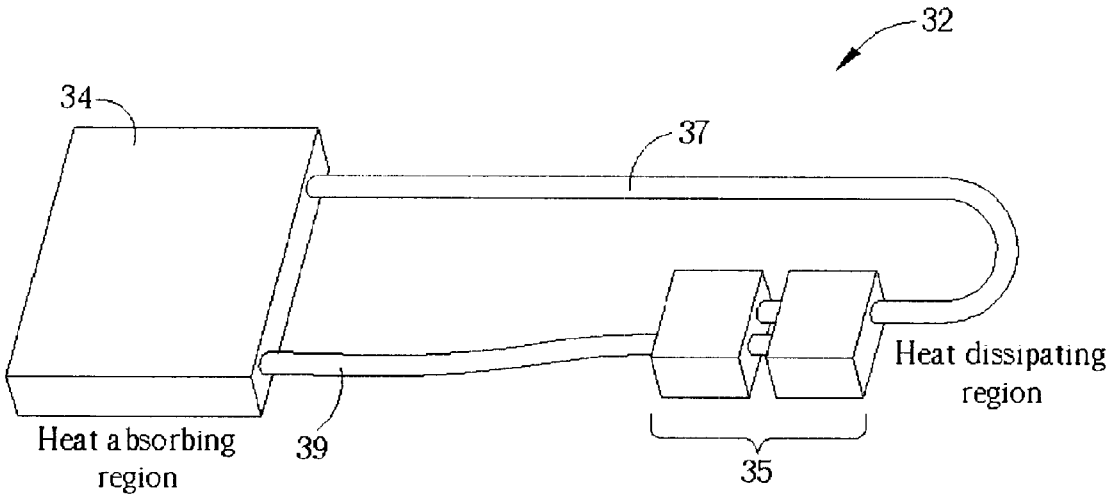
Fig. 3 Prior art
FIG. 3 is an illustration of a looped heat tube according to the prior art.
Figure 4:
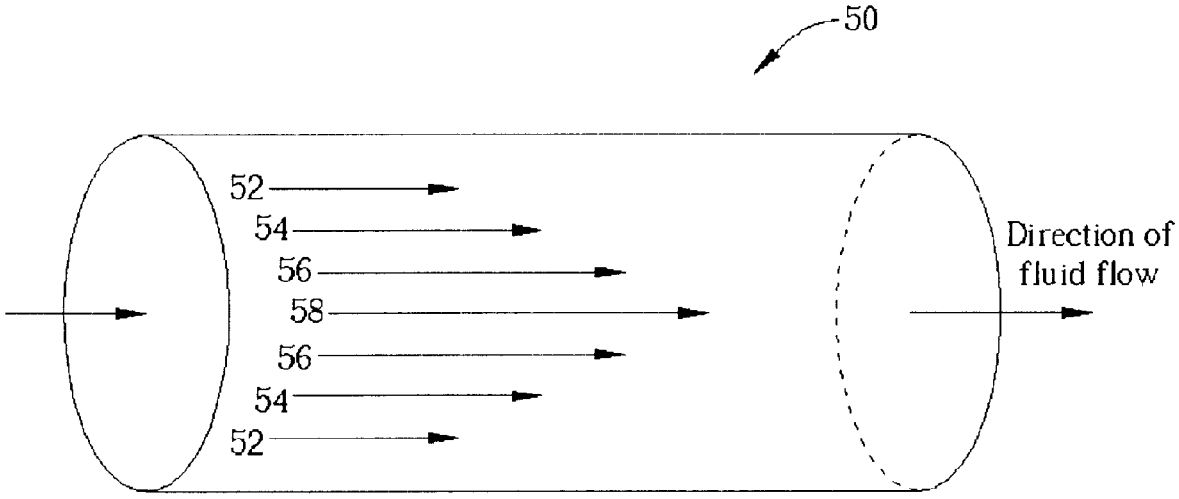
Fig. 4 Prior art
FIG. 4 illustrates the relative velocities of a fluid flowing through a pipe.
Figure 5A:
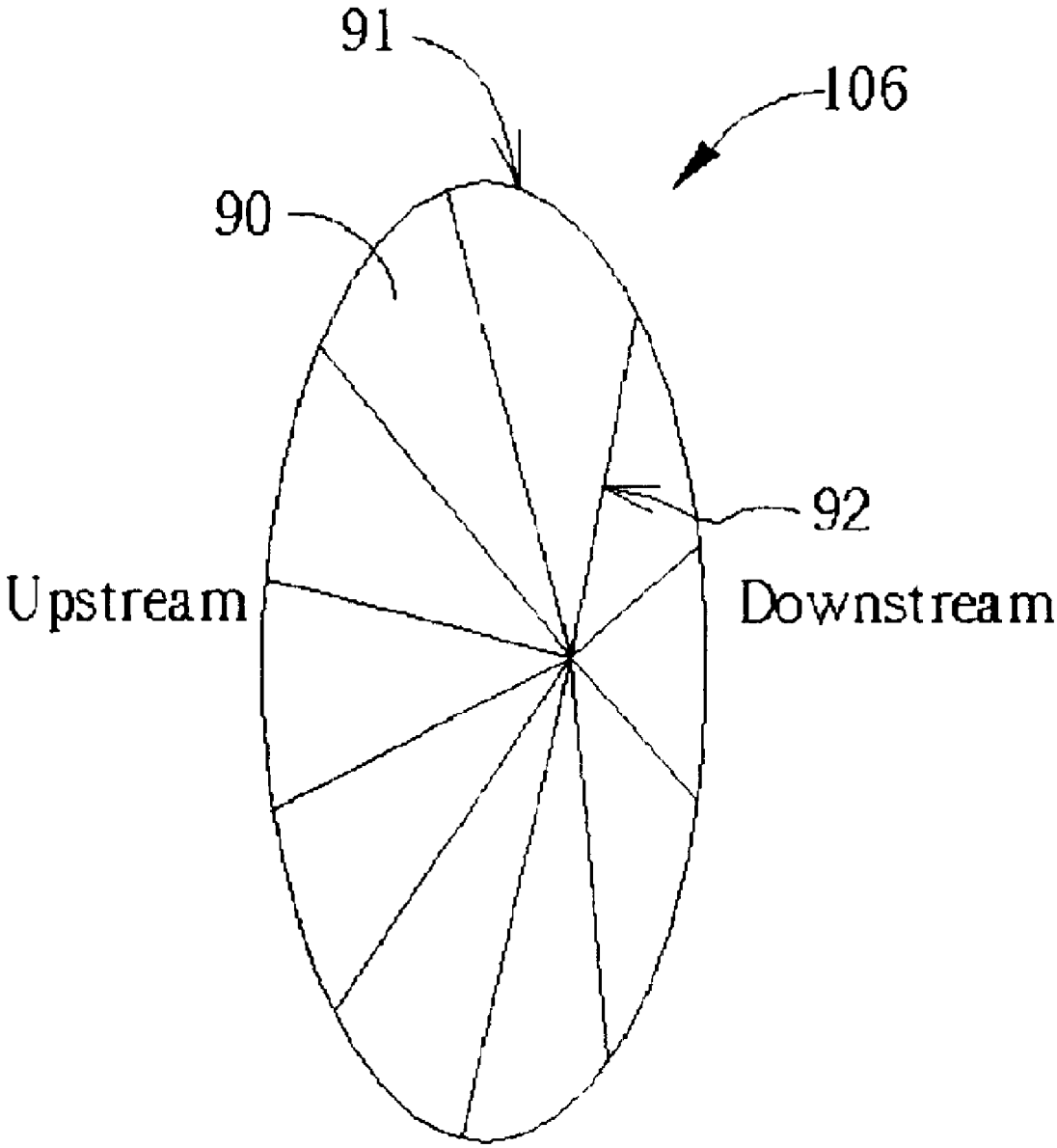
FIG. 5*a* is a diagram of a closed orientation of a radially segmented disk according to the present invention.
Figure 5B:
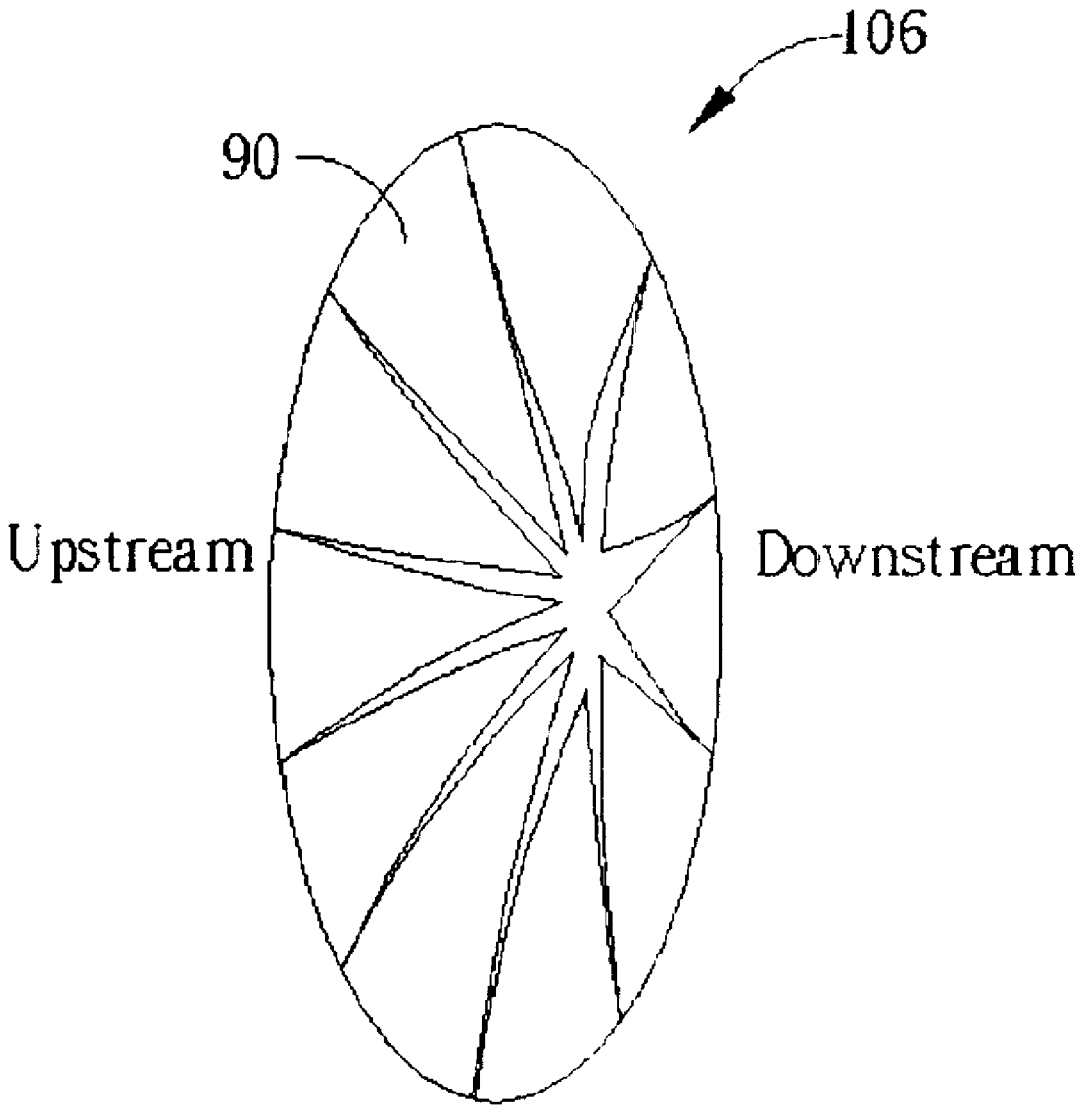
FIG. 5*b* is a diagram of an open orientation of the radially segmented disk of FIG. 5*a*.
Figure 6:
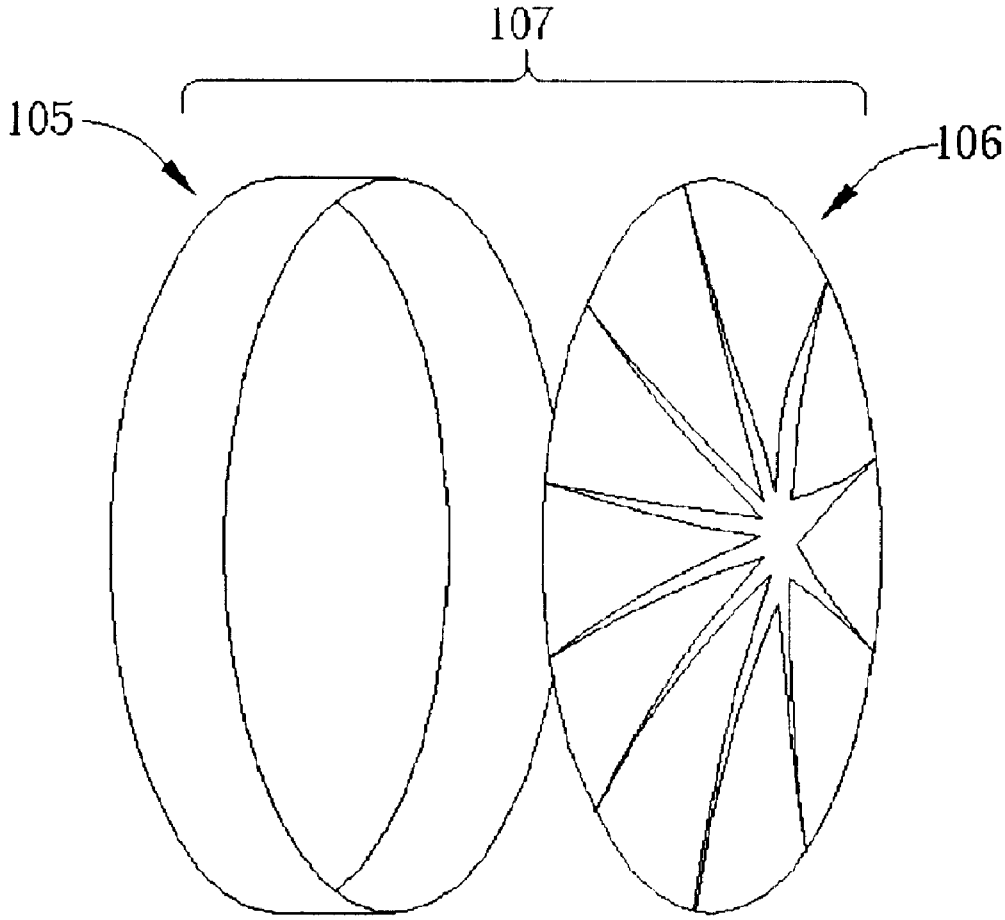
FIG. 6 is an exploded view of a spacing ring and radially segmented disk according to the present invention.

The radially segmented disk unit 107 shown in FIG. 5*a*, FIG. 5*b*, and FIG. 6 comprises a radially segmented disk 106 and a thin-walled, pipe-shaped spacing ring 105. While this embodiment of the present invention uses a separate radially segmented disk 106 and spacing ring 105, a single, unified structure providing similar functionality also falls within the scope of the invention. The outer surface of the spacing ring 105 forms an airtight seal with the inner surface of the tube 99 for preventing fluid from flowing around the radially segmented disk unit 107. The spacing ring 105 is of a length sufficient to securely fix the radially segmented disk unit 107 within the tube 99 and maintain adequate separation between the radially segmented disk units 107 for proper functionality. The thin walls of the spacing ring 105 provide a tubular passageway for the working fluid and help to reinforce the strength of the tube 99.

The radially segmented disk 106 comprises a plurality of segments 90 arranged in substantially in a single plane when in a closed orientation as shown in FIG. 5*a*. An outer edge 91 of each segment 90 is hinged to the spacing ring 105 such that the segments 90 are able to pivot from the closed orientation shown in FIG. 5*a* to the open orientation shown in FIG. 5*b* with the segments 90 extending in a downstream direction. The hinges are precision made, long lasting, and may be elastically operated so that in the relative absence of outside forces, the segments 90 will return to the closed orientation. The segments 90 are prevented from pivoting from the closed orientation to extend in an upstream direction by the spacing ring 105 or any other method such as precision tolerances or by having the radially segmented disk 106 form a slightly convex shape in the closed orientation if viewed from the downstream side of the radially segmented disk 106.

In operation, the working fluid 101 in a chamber 94 in the heat absorbing region 102 absorbs heat from the heat source. The absorbed heat vaporizes at least part of the working fluid 101 and creates a pressure within the chamber 94 greater than a pressure in an adjacent downstream chamber 96. The increased pressure in the chamber 94 causes the radially segmented disk 106 separating the chamber 94 from the chamber 96 to change from a closed orientation to an open orientation allowing fluid to flow from the chamber 94 to the chamber 96, releasing some of the increased pressure in chamber 94 into chamber 96. This in turn increases the pressure in chamber 96, which causes the next downstream radially segmented disk 106 to open, releasing pressure from chamber 96 into an adjacent downstream chamber 98. The process continues with pressure forcing the circulation of the working fluid 101 from one chamber to the next.

The heat absorbed from the heat source into the working fluid 101 is released into the heat dissipater through condensation of the working fluid 101. The condensation of the working fluid 101 reduces pressure within the chamber 98 near the heat dissipating region and creates a pressure difference between the chambers 96 and 98, adding further circulatory forces to the fluid.

When the radially segmented disk 106 changes from a closed orientation to an open orientation, each segment 90, by pivoting toward the downstream direction helps to propel the working fluid 101 further in the downstream direction, aiding circulation. Side edges 92 of the segments 90 form narrow slits between two adjacent segments 90 allowing the slower moving, cooler working fluid 101 near the walls of the tube 99 to enter the adjacent chamber as well as the faster moving, warmer center portions of the working fluid 101, improving fluid flow. Additionally, the movement of the segments 90 relative to the working fluid 101, function to increase the levels of turbulence within the flow of the working fluid 101. The increase in turbulence reduces the shear effect and increases the rate of heat transfer from the heat source to the working fluid 101 and from the working fluid 101 to the heat dissipater, improving the heat transferring abilities of the heat pipe 100 . The optimal amount of desired turbulence within the working fluid 101 normally depends on the specific application of the heat pipe 101 and can be controlled by the precise shape and dimensions of the tube 99 and the segments 90. While the present invention is not to be limited by the exact amount of turbulence, levels giving a Renolds Number of less than three thousand would be appropriate to avoid creating too much unwanted drag.

At least one radially segmented disk 106 must be present in the tube 99 for the invention to operate properly and only the length of the tube 99 and the spacing rings 105 required to insure adequate room for the radially segmented disk 106 to function properly limit the maximum number of radially segmented disks 106 within the tube 99. However, it is worth noting that by placing a plurality of radially segmented disks 106 near the heat absorbing region and near the heat dissipating region and no radially segmented disks 106 in the other sections of the tube 99, minimum drag will be produced in the sections of the tube 99 merely transferring the working fluid 101 and maximum ability for transferring heat to and from the working fluid 101 will be located in the desired regions. Additionally, the outside of the heat pipe 100 can be covered with an electrically insulating or thermally insulating material exposing only the heat absorbing region 102 and the heat dissipating region 104. The insulating material protects devices in the area from unwanted heat radiated from the heat pipe 100 and allows the heat pipe 100 to be used in device areas without causing electrical shorts or other electrical concerns.

In contrast to the prior art, the present invention uses a radially segmented disk to control the working fluid 101 flow direction within the heat pipe. Each segment 90 of the radially segmented disk 106 reinforces pressure forces to propel the working fluid downstream. Slits between the edges 92 of adjacent segments 90 allow better circulation of the working fluid 101 near the outside walls of the tube 99 than is provided for in the prior art check valves. Additionally, each segment 90 introduces turbulence into the working fluid 101, reducing shear forces and increasing the rate of heat transfer from the heat absorbing region 102 to the working fluid 101 and from the working fluid 101 to the heat dissipating region 104.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A heat pipe for transferring heat from a heat source to a heat dissipater, the heat pipe comprising:

a tube of sufficient length to form a closed loop, the tube comprising a heat absorbing region for contacting at least a portion of the heat source and a heat dissipating region for contacting at least a portion of the heat dissipater;

a working fluid sealed within the tube for transferring heat from the heat absorbing region to the heat dissipating region; and a plurality of radially segmented disks each comprising a plurality of segments having edges, the edges of each segment for causing increased turbulence in the working fluid for increasing the rate of heat transfer to the working fluid from the heat absorbing region and for increasing the rate of heat transfer from the working fluid to the heat dissipating region.

2. The heat pipe of claim 1 wherein each segment of the radially segmented disk is capable of pivoting to an open orientation and returning to a closed orientation for restricting flow of the working fluid flow to a single direction.

3. The heat pipe of claim 2 wherein the segments in the closed orientation form a structure preventing the flow of the working fluid through the tube in an upstream direction, the segments in the open orientation form a structure permitting the flow of the working fluid through the tube in a downstream direction by having each segment extend in a downstream direction, the upstream direction being opposite to the downstream direction.

4. The heat pipe of claim 3 wherein when the segments are in the open orientation and the pressure of the working fluid from the upstream direction is not greater than the pressure of the working fluid from the downstream direction, the segments return to the closed orientation.

5. The heat pipe of claim 3 wherein when a pressure of the working fluid from an upstream direction relative to the radially segmented disk is greater than a pressure of the working fluid from a downstream direction relative to the radially segmented disk, the pressure difference causes the segments to pivot from the closed orientation to the open orientation and the working fluid is propelled through the tube in the downstream direction by the pivoting segments.

6. The heat pipe of claim 5 wherein a difference in pressure is the result of the working fluid changing from a liquid state to a gaseous state at a predetermined temperature.

7. The heat pipe of claim 2 wherein the segments in a closed orientation form a substantially planar structure.

8. The heat pipe of claim 2 wherein the segments in a closed orientation form a convex structure on a side of the radially segmented disk in contact with downstream working fluid.

9. The heat pipe of claim 2 wherein when the segments are in the closed orientation, the segments form a seal preventing the flow in an upstream direction of the working fluid through the tube.

10. The heat pipe of claim 1 further comprising a spacing ring of a dimension such that an inner surface of the spacing ring forms a tubular passageway for the working fluid and such that an outer surface of the spacing ring fixes flush against an inner surface of the tube preventing the working fluid from flowing between the spacing ring and the tube.

11. The heat pipe of claim 10 wherein an outer edge of each segment is hinged to the spacing ring.

12. The heat pipe of claim 10 wherein each segment is elastically hinged to the spacing ring so that in the absence of substantial outside forces the segments will return to the closed orientation.

13. The heat pipe of claim 10 wherein the spacing ring and the radially segmented disk are comprised by a single unified radially segmented disk unit.

14. The heat pipe of claim 1 wherein the tube is manufactured in any combination of curved portions and straight portions limited only by the physical operating limits of the radially segmented disk.

15. The heat pipe of claim 1 wherein the heat source is above the heat dissipater.

16. The heat pipe of claim 1 wherein the tube is made substantially of copper or aluminum.

17. The heat pipe of claim 1 wherein the outer surface portions of the tube not defined as the heat absorbing region and not defined as the heat dissipating region are enclosed in an electrically insulating material.

18. The heat pipe of claim 1 wherein the outer surface portions of the tube not defined as the heat absorbing region and not defined as the heat dissipating region are enclosed in thermally insulating materials.

19. The heat pipe of claim 1 wherein each segment of the radially segmented disk is substantially triangular.

20. The heat pipe of claim 1 wherein the cross-sectional shape of the tube is selected from the group consisting of elliptical, rectangular, triangular, pentagonal, hexagonal, or octagonal.

* * * * *